US005339733A

United States Patent [19]

Malin

[11] Patent Number: 5,339,733

[45] Date of Patent: Aug. 23, 1994

[54] APPARATUS FOR SENSING MAIL PIECE SURFACE CONTOUR

[75] Inventor: Richard A. Malin, Westport, Conn.

[73] Assignee: Pitney Bowes Inc., Stamford, Conn.

[21] Appl. No.: 133,421

[22] Filed: Oct. 8, 1993

[51] Int. Cl.[5] ..... B41L 47/46

[52] U.S. Cl. ..... 101/91; 364/464.02; 324/207.13

[58] Field of Search ..... 101/91, 71; 53/457; 400/56, 120; 346/76 PH, 140; 250/222.1; 364/464.02; 324/207.13

[56] References Cited

U.S. PATENT DOCUMENTS

| | | | |
|---|---|---|---|
| 4,418,515 | 12/1983 | Foster et al. | 53/457 |
| 4,637,051 | 1/1987 | Clark | 101/71 |
| 4,879,513 | 11/1989 | Spiegel et al. | 324/207.13 |
| 4,907,013 | 3/1990 | Hubbard | 250/222.1 |
| 4,949,098 | 8/1990 | Gluck | 400/56 |

*Primary Examiner*—Eugene H. Eickholt

*Attorney, Agent, or Firm*—Charles G. Parks, Jr.; Melvin J. Scolnick

[57] ABSTRACT

A mailing machine is disclosed which includes an apparatus for scanning the surface contour of mail pieces as they move along a feed path prior to being engaged by the printing device of a postage meter to determine whether the surface contour of the mail piece in the area where printing is to take place is suitable for printing and for actuating an instrumentality intended to prevent printing of the postage indicia in that area if the printing surface is not suitable for receiving a good quality print. There is an electro-optical information generating means which is operated by a scanning means, and a controller means receives and interprets information from the electro-optical means to determine whether the information exceeds threshold limits for the information stored in a memory in the controller means, in which case the controller means produces an output signal to an actuator which initiates appropriate action intended to prevent printing of the postage indicia on the mail piece in the area where the surface is not acceptable for printing.

9 Claims, 3 Drawing Sheets

APPARATUS FOR SENSING MAIL PIECE SURFACE CONTOUR

BACKGROUND OF THE INVENTION

The present invention relates generally to the field of mailing machines, and more particularly to a mailing machine which includes an apparatus for sensing thickness variations in the surface contour of pieces of mail to avoid printing postage indicia on mail pieces in areas on the mail pieces having surface contours unacceptable for printing.

Mailing machines have long been well known and have been developed over time to a high level of technical sophistication and complexity of features of operation. For these reasons, mailing machines have become very attractive to low, medium and high volume mailers, and technological advancements are constantly underway to further enhance the advantages and desirability of these machines. One of the advantageous features of operation is that modern day mailing machines can handle mail pieces having variable thickness, ranging from air mail thickness up to about a quarter of an inch, without having to make any mechanical adjustments to any the operating components of the mailing machine. This is a significant advantage of mailing machines from the economic standpoint in that relatively inexpensive, low volume mailing machines would not be provided with such adjustment mechanism in order to maintain a low cost, and the provision of such mechanism in a high speed, high volume mailing machine would inevitably have a deleterious effect on the speed of operation if the machine had to make mechanical adjustments to accommodate mail pieces of varying thickness.

One problem which arises in the operation of mailing machines is that of printing a postage indicia on a mail piece that does not have a smooth surface in the area in which it is desired to print a postage indicia. As is generally known, the principal function of a mailing machine is to print a postage indicia on a piece of mail in lieu of affixing a postage stamp. The mailing machine includes a base having a feed deck for supporting a mail piece, and in more sophisticated machines, a feeding mechanism for automatically and sequentially feeding successive mail pieces along the feed deck. The mailing machine also includes a postage meter including a printing device for printing the postage indicia on the mail piece, either while it is stationary or is being fed along the feed deck.

The U.S. Postal Service has promulgated regulations regarding the printing of postage indicia on mail pieces, the essence of which, so far as the present invention is concerned, is that the printed indicia must conform to a minimum standard of quality. Basically, the Postal Service regulations require that the postage indicia be printed in the upper right hand corner of an envelope if at all possible, that the imprint be readily legible, free from all forms of smudges or blurred print, and that there be no spurious markings adjacent to the indicia imprint.

The problem that arises is that it is virtually impossible to print a postage indicia on a mail piece which meets these requirements unless the surface of the mail piece on which the indicia is to be printed is relatively smooth and flat. This problem is characteristic of all forms of printing devices normally utilized in postage meters. The majority of postage meters utilize a metal or rubber die having the image of the postage indicia embossed thereon; the die is coated with ink and is pressed onto the surface of the mail piece to transfer the ink from the die to the mail piece. However, other printing processes can be utilized, such as dot matrix, thermal, ink jet and laser, but they all require a relatively flat and smooth surface on which to print the postage indicia.

The problem typically arises when mail pieces are improperly prepared for mailing. For example, if the mailer folds a large number of pieces of paper and inserts them into an envelope, the abrupt edge of the thick packet of folded paper forms a void within the envelope adjacent the edge, and if this edge is in the area when the postage indicia is to be printed, the printing die, or other printing element depending on the process used, will not be properly supported on the surface of the mail piece, which results in blank areas in the postage indicia imprint. Another problem frequently encountered is that of objects, such as staples or paper clips, being placed in envelopes which create bumps or other irregularities on the surface of the mail piece, resulting in a surface contour of sufficient irregularity that it is impossible to obtain an acceptable postage indicia imprint. As a practical matter, the only solution to these and other similar problems is simply to avoid printing on a mail piece in surface areas having this degree of surface irregularity.

Thus, there is a need for an apparatus that can be incorporated into a typical mailing machine that has the capability of scanning the surface contour of a mail piece in the area in which a postage indicia is to be printed to determine whether the surface contour is suitable for printing, and which actuates an instrumentality intended to prevent the printing from taking place in that area if the surface contour is determined to exceed a minimum acceptable level of surface contour irregularity.

SUMMARY OF THE INVENTION

The present invention eliminates the foregoing problems and achieves the foregoing objective. In its broader aspects, the present invention comprises an apparatus for scanning the surface contour of a mail piece as it moves along a feed path through a mailing machine, the scanning taking place prior to the mail piece being engaged by the printing device of the postage meter, to determine whether the surface contour of the mail piece, in the area where printing is to take place, is suitable for printing, and to initiate an instrumentality the function of which is to prevent the printing of the postage indicia in that area. The apparatus includes a sensing means disposed adjacent to the feed path of the mailing machine for contacting the surface of the mail piece as it moves along the feed path. There is means mounting the sensing means for movement in a direction toward and away from the surface of the mail piece in response to variations in the contour of the surface. An electro-optical means is operatively associated with the mounting means and responsive to movement of the mounting means for generating information indicative of the extent of movement of the sensing means. A controller means receives the interprets the information to determine whether the information exceeds threshold limits for the information stored in a memory in the controller means, the controller means also including means for producing an output signal if the information received from the electro-optical means does in fact exceed the threshold limits stored in memory. Finally, there is means responsive to the output signal from the controller means for activating an instrumentality that is intended to prevent a printing operation from taking place on an unacceptable area of the mail piece.

In some of its more limited aspects, the sensing means comprises a plurality of follower elements, preferably rollers, mounted in side by side relationship, which independently scan the surface of the mail piece, each of the rollers being mounted on a follower arm which is mounted for pivotal movement in response to movement of the follower elements from variations in the thickness of the mail piece. The follower arms include means operatively associated with the electro-optical means for causing the latter to generate the aforementioned information in varying degree so that the information is indicative of the extent of movement of the follower arms, the electro-optical means preferably being a source of illumination and an array of sensing elements as embodied in a charge coupled device.

The information generated by the electro-optical means is received and interpreted by a microprocessor controller, where the information is compared against threshold information stored in the microprocessor memory. If the generated information relating to the surface contour of a mail piece exceeds the threshold information stored in the controller, the controller generates a signal which activates an instrumentality intended to prevent a printing operation from taking place on an area of the mail piece having an unacceptable surface contour, such as sounding an alarm in a manually fed mailing machine to alert the user not to insert that particular mail piece into the printing device of the postage meter, or automatically disabling the printing device of more sophisticated mailing machines in which mail pieces are automatically and successively fed to the postage meter.

Having briefly described the general nature of the invention, it is a principal object thereof to provide an apparatus for scanning the surface contour of mail pieces as they move along the feed path or a mailing machine prior to the mail pieces being engaged by the printing device of the postage meter to determine whether the surface contour of the mail piece is suitable for printing.

It is another object of the present invention to provide an apparatus for scanning the surface contour of mail pieces as above described which has the capability of activating an instrumentality intended to prevent a printing operation from taking place on a particular area of the mail piece if the scanning apparatus determines that the surface contour of that one area of the mail piece is unacceptable for printing.

These and other objects of the present invention will become more apparent from an understanding of the following detailed description of a presently preferred embodiment of the invention when considered in conjunction with the accompanying drawings.

DETAILED DESCRIPTION OF THE INVENTION

Figure 1:
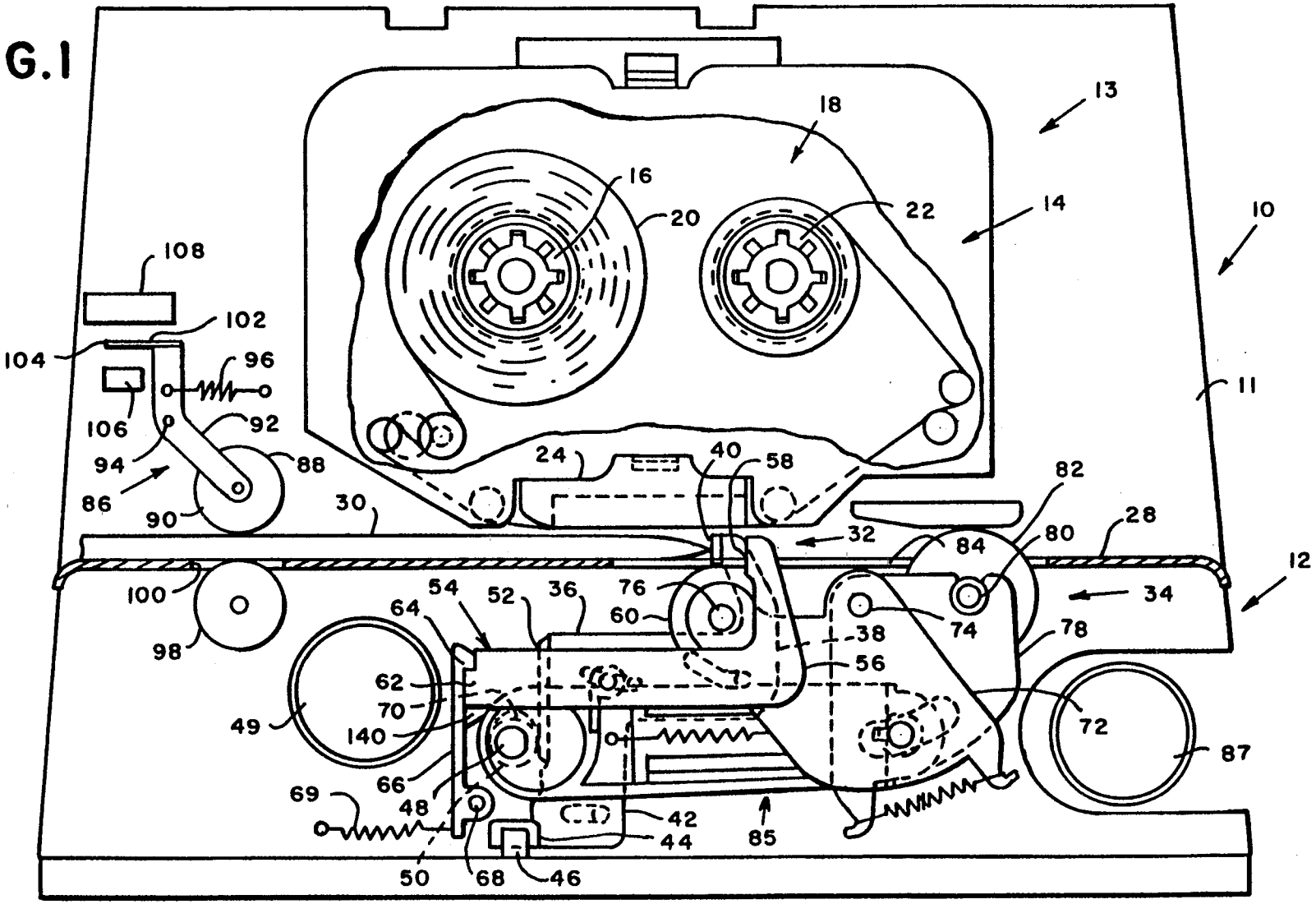
FIG. 1 is a partly sectional front view of a mailing machine embodying the scanning apparatus of the invention.

Referring now to the drawings, and more particularly to FIG. 1 thereof, the is seen a mailing machine, generally designated by the reference numeral 10 which embodies the present invention. The mailing machine 10 includes a vertically oriented registration wall 11 on which many of the components of the mailing machine are mounted, as will be seen hereinafter, and a base, generally designated by the reference numeral 12, on which the registration wall 11 is suitably mounted and which also supports many of the envelope feeding and registration parts, as will be seen hereinafter. For purposes of illustration, the mailing machine 10 includes a postage meter, generally designated by the reference numeral 13 which has a thermal printing device, generally designated by the reference numeral 14. It should be understood that many of the details of the mailing machine 10 are not hereinafter described since they form no part of the present invention, and that only those which are pertinent to an understanding of the invention are described. For a fuller understanding of the mailing machine 10, attention is directed to U.S. patent application Ser. No. 950,341, filed Sep. 24, 1992, and assigned to the assignee of this application.

Still referring to FIG. 1, it will be seen that the thermal printing device 14 includes a supply reel 16 mounted in a ribbon cassette 18 for easy installation into and removal from the printing device 14. The reel 16 holds a supply of thermal ink ribbon 20 which is attached to a driven take up spool 22, by which the ribbon is pulled through the printing device 14 beneath a print head 24. The print head, the details of which are well known and need not be further described, generally is of the type which includes an array of heating elements which are electrically energized to heat up in a pattern corresponding to the image of the postage indicia to be printed. The image of the heating elements is controlled by software stored in the printing device 14, which can be changed at will by techniques well known in the art.

The base 12 of the mailing machine 10 includes a feed deck 28 which extends generally the width of the mailing machine 10 and supports the mail piece 30 as it moves through the mailing machine. As will be more fully explained below, the base 12 includes a mail piece position sensing assembly, generally designated by the reference numeral 32, and a platen and eject roller assembly, generally designated by the reference numeral 34. The mail piece position sensing assembly 32 comprises a generally horizontally disposed lever 36 suitably pivotally mounted in the base 12 and having vertically oriented downstream portion 38 which terminated upwardly in an abutment surface 40 normally disposed in the path of the leading edge of a mail piece 30. The lever 36 also has a vertically oriented upstream portion 42 extending downwardly and terminating in a sensor tab 44 which is adapted to activate a sensor 46 for a purpose hereinafter described. A shaft 48 is suitably mounted in the base 12, the shaft carrying an eccentrically mounted cam 50 which, upon rotation of the shaft 48, bears against a cam surface 52 formed on the upstream end of the horizontal portion of the level 36. The shaft 48 is suitably geared to a motor 49, itself suitably mounted in the base 12, which is energized by unblocking the sensor 46 when the lever 36 moves the sensor tab 44 away from it. The cam 50 pivots the lever 36 in a clockwise direction to depress the abutment surface 40 beneath the surface of the feed deck 28, thereby permitting the mail piece 30 to pass thereover.

The platen eject roller assembly 34 includes another generally horizontally oriented lever 54 which is suitably pivotally mounted in the base 12, the lever 54 having a vertically oriented portion 56 on the downstream end thereof which terminates upwardly in a mail piece registration stop surface 58, which is positioned to be generally coincident with the location of a platen roller 60, further described below. The lever 54 terminates in an upstream direction in a lock tab 62 which is engaged by a lock notch 64 formed on the upper end of a lock lever 66 pivotally mounted in the base 12 on a stub shaft 68. The lock lever 66 is urged in a clockwise direction about the stub shaft 68 by a tension spring 69 so as to normally maintain the lock notch 64 engaged with the lock tab 62 on the lever 54. The aforementioned shaft 48 also carries another cam 70 which, upon rotation of the shaft 48, first engages the lock lever 66 to pivot it counter-clockwise to release the lock tab 62 from the lock notch 64 and then pivot the lever 54 in a clockwise direction to depress the stop surface below the level of the feed deck 28, thereby permitting the mail piece 30 to pass thereover.

The platen and eject roller assembly 34 comprises a first link plate 72 which is pivotally mounted on a stub shaft 74 suitably secured in the base 12 and which supports the shaft 76 on which the platen roller 60 is rotatably mounted. A second link plate 78 is pivotally mounted on the stub shaft 74 and supports a shaft 80 on which an eject roller 82 is mounted. Both the platen roller and the eject roller can contact the underside of a mail piece 30 by projecting through a slot 84 formed in the feed deck 28. The rocking operation of the platen roller 60 and the eject roller 82 is controlled by a linking arm assembly, generally designated by the reference numeral 85, which is suitably interconnected to the shaft 48. The platen and eject rollers are suitably geared to a second motor 87 suitably mounted in the base 12. Further explanation of the linking arm assembly 85 is not necessary for an understanding of the present invention, and attention is directed to the previously mentioned copending application for a complete description thereof.

From the description thus far, it will be apparent that when the mail piece 30 is moved from left to right in FIG. 1 along the feed deck 28, either manually or by a feeding device, and the lead edge thereof strikes the abutment surface 40, the lever 36 is pivoted in a clockwise direction enough to move the sensor tab 44 away from the sensor 46, which in turn activates the motor 49 to drive the shaft 48. Rotation of the shaft 48 rotates the eccentric cam 50 which moves the cam surface 52 in a downstream direction, thereby further pivoting the lever 36 in a clockwise direction far enough to depress the abutment surface 40 below the feed deck 28 to permit the mail piece 30 to pass thereover. The lead edge of the mail piece then strikes the registration stop surface 58 so that the mail piece is properly registered with the platen roller 60. Further rotation of the cam shaft 48 turns the cam 70 so that it rocks the lock lever 66 in a counter-clockwise direction so that the lock notch 64 releases the lock tab 62, thereby allowing the lever 54 to be pivoted in a clockwise direction by further rotation of the cam 70 until the registration stop surface is also depressed below the surface of the feed deck 28. Continued rotation of the shaft 48 actuates the linking arm assembly 85 which in turn rocks the platen and eject roller assembly 34 in a clockwise direction about the shaft 74 to bring the platen roller 60 into contact with the lower surface of the mail piece, and to remove the eject roller 82 out of the path of the mail piece.

After the platen roller has fully engaged the mail piece 30, the motor 87 and another motor (not shown) for driving the thermal ribbon take up spool 22 are energized is by suitable controls in the mailing machine to drive the platen roller and the eject roller, as well as the thermal ribbon 20. Although the motor 87 drives both the platen roller 60 and the eject roller 82, the latter has no effect since it is depressed below the level of the feed deck 28. The platen roller moves the mail piece 30 at the same speed as the thermal ribbon is moving across the print head 24. Printing of the postage indicia commences by loading data to the print head from a microprocessor controller in the thermal printer 14. When the postage indicia is fully printed, the controller causes further rotation of the cam shaft 48 which acts on the linking arm assembly 85 to pivot the link plates 72 and 78 in a counter-clockwise direction to depress the platen roller below the feed deck 28 to disengage it from the envelope.

Simultaneously, the drive to the thermal ribbon take-up spool is discontinued so as not to waste thermal ribbon while the eject roller 82, which has been raised by the pivoting movement of the link plates 72 and 78 to engage the lower surface of the mail piece and eject it from the mailing machine.

Referring now to FIGS. 1 through 4, it will be seen that the mail piece scanning apparatus, generally designated by the reference numeral 86, is disposed in the mailing machine in an upstream direction so that the scanning apparatus will scan the surface contour of the mail pieces as they move along the feed deck 28 prior to being engaged by the platen roller 60. The scanning apparatus comprises a plurality of sensing means preferably in the form of rollers 88 which are disposed adjacent the feed deck 28 so as to contact the upper surface of a mail piece 30. The rollers 88 are each mounted on stub shafts 90 which are carried by a mounting means comprising a corresponding plurality of follower arms 92 which are pivotally mounted on a common shaft 94 suitably fixed to the registration wall 11. Each follower arm 92 is urged in a clockwise direction about the shaft 94 by a tension spring 96 that has one end connected to the upper portion of the follower arm 94 and the other end suitably connected to the registration wall 11. Thus, the rollers 88 are biased into intimate contact with the upper surface of the mail piece 30, which is supported opposite the rollers 88 by a backup roller 98 which extends through a slot 100 in the feed deck 28 across at least the portion of the mail piece on which the postage indicia is to be printed, if not across the entire width of the mail piece. The backup 98 may be conveniently driven by suitable connection to a motor in the mailing machine which drives other feed rollers therein.

The top of each follower arm 92 carries a mask 102 which has a tapered portion 104 that extends beyond the follower arm 92. A suitable radiation source 106 is suitably mounted on the registration wall 11 and is disposed adjacent the upper ends of the follower arms 92 in juxtaposition to the masks 104 so that the masks can obstruct more or less of the radiation, depending upon the degree of movement of the follower arms 92. In the preferred embodiment of the invention, the radiation source 106 is an LED array which extends across the plurality of rollers 88, follower arms 92 and masks 104. A charge coupled device (CCD) array 108 is suitably mounted on the registration wall 11 in juxtaposition to the masks 104 on the opposite side thereof from the LED array 106 so that the individual cells thereof receive illumination from the LED array 106 in varying intensity and number depending upon the position of the masks 104. The CCD array is of conventional construction and need not be described in detail for the purposes of this invention other than to note that it is a multielement sensing and storage device that has the capability of photoelectrically converting the energy of illumination from the LED array 106 to a photoelectric current which becomes the charge stored in individual capacitors. Periodically, the CCD array is put into a scanning mode and the charges stored in the individual capacitors or cells are transferred in a serial manner to an output section where they are converted into an output voltage that is proportional to the amount of illumination that reached the individual cells during an exposure interval. The tapered portions 104 of the masks 102, the LED array 106 and the CCD array 108 constitute an electro-optical assembly which is operatively associated with the follower arms 92 and response to movement thereof for generating electrical information indicative of the degree of movement of the rollers 88 in a manner more fully described below.

Figure 2:
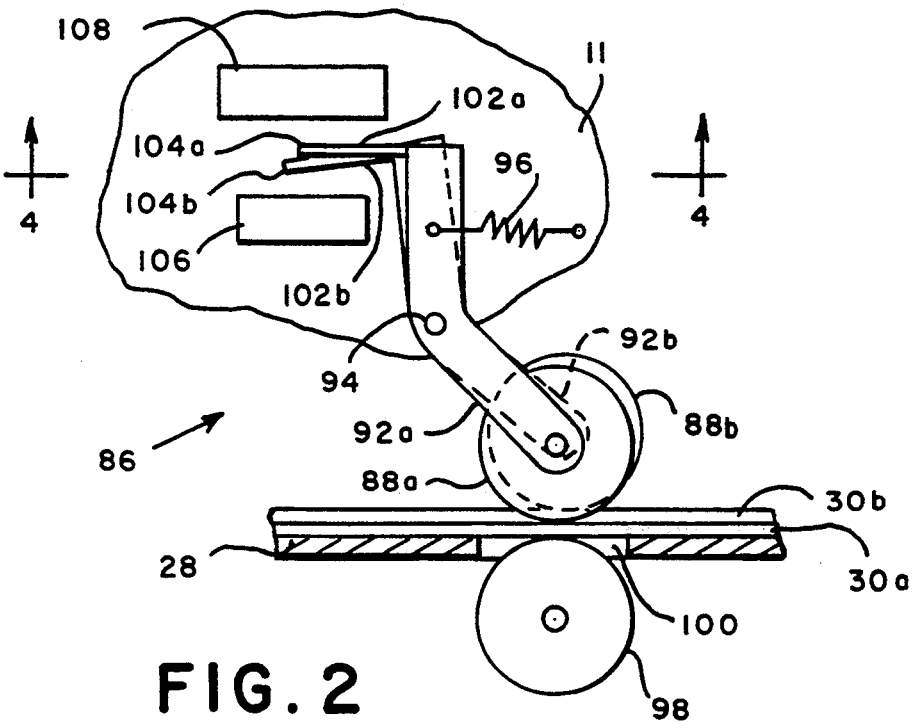
FIG. 2 is a side elevation of the details of the scanning apparatus shown in FIG. 1.
Figure 3:
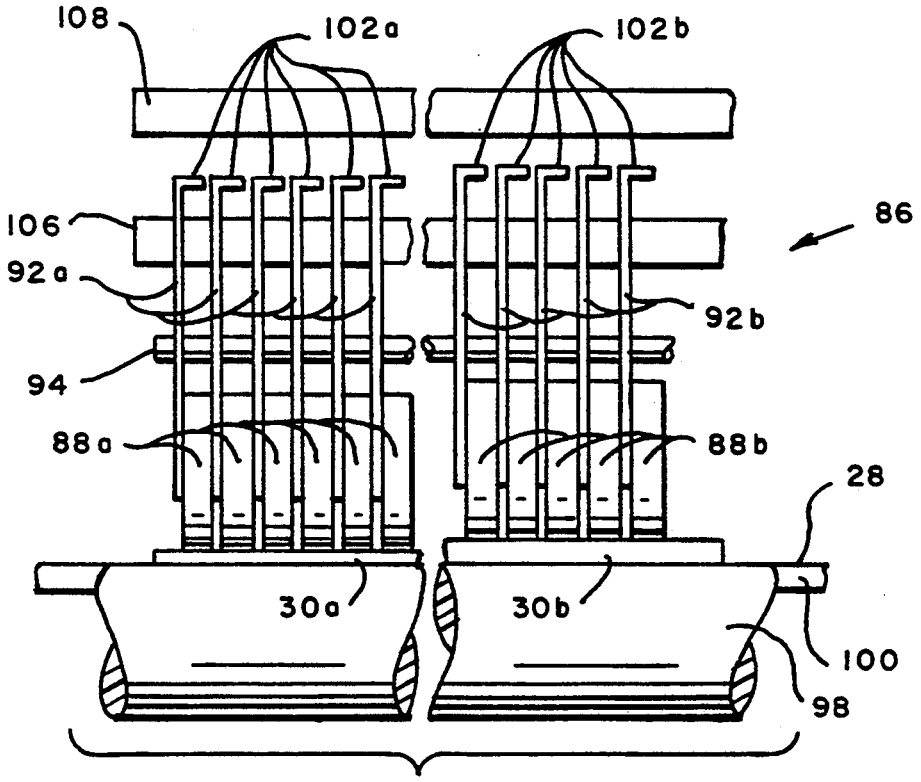
FIG. 3 is a front elevation of the scanning apparatus shown in FIG. 2.
Figure 4:
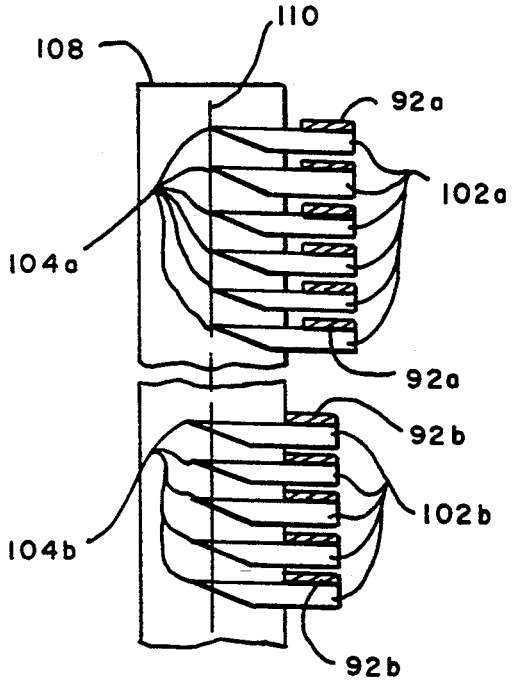
FIG. 4 is a bottom view of the of the CCD array taken on the line 44 of FIG. 2.

FIGS. 2, 3 and 4 illustrate the manner in which the scanning apparatus 86 determines whether the surface of a mail piece 30 is suitable for printing. As best seen in FIG. 3, the mail piece being scanned has two portion 30*a* and 30*b* each having different thicknesses, the thickness of the portion 30*a* being a relatively standard thickness for an ordinary mail piece, the thickness of the portion 30*b* being substantially greater than that of the portion 30*a*, caused perhaps by an object within the mail piece. It will be seen that a plurality of rollers designated 88*a* contact the mail piece portion 30*a* of standard thickness and another plurality of rollers designated 88*b* contact the mail piece portion 30*b*. As best seen in FIG. 2, the follower arms 92*a* connected to the rollers 88*a*, are in their normal position under the influence of the springs 96, which results in the tapered portions 104*a* of the masks 102*a* permitting illumination from the LED array 106 to reach most of the individual cells of the CCD array 108, which is represented by the line 110 in FIG. 4. However, the follower arms 92*b* connected to the rollers 88*b* are displaced in a counter-clockwise direction due to the upward movement of the rollers 88*b* caused by the portion 30*b* of increased thickness passing between the rollers 88*b* and the backup roller 98. This counter-clockwise movement of the rollers 92*b* causes the tapered portions 104*b* of the masks 102*b* to extend further across the CCD array 108, thereby obscuring more of the individual cells of the CCD array 108 from the illumination of the LED array 106.

Figure 5:
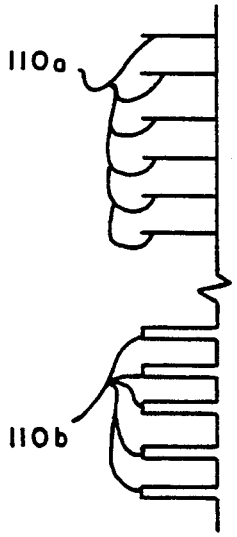
FIG. 5 is a diagrammatic illustration of the amplitude/time trace of the output of the CCD array.

FIG. 5 illustrates a representative amplitude/time trace of the CCD output for the two sections 30*a* and 30*b* of the mail piece 30. Each time the CCD array 108 is scanned, the individual cells of the CCD array 108 associated with a particular roller 88 produce an output signal which, in terms of number or time (there is one cell for each readout clock cycle) and amplitude, varies in accordance with the thickness of the mail piece at the location of that roller 88. Thus, the lines 110*a* represent the signals from the CCD cells responsive to the rollers 88*a* riding over the thin portion 30*a* of the mail piece, and the lines 110*b* represent the signals from the CCD cells responsive to the sensor rollers 88*b* riding over the thick portion 30*b* of the mail piece. Although only two different thicknesses of the mail piece 30 have been shown for illustrative purposes, it will be apparent that there can be as many different thicknesses of the mail piece 30 represented by the amplitude/time trace as there are rollers 88.

Figure 6:
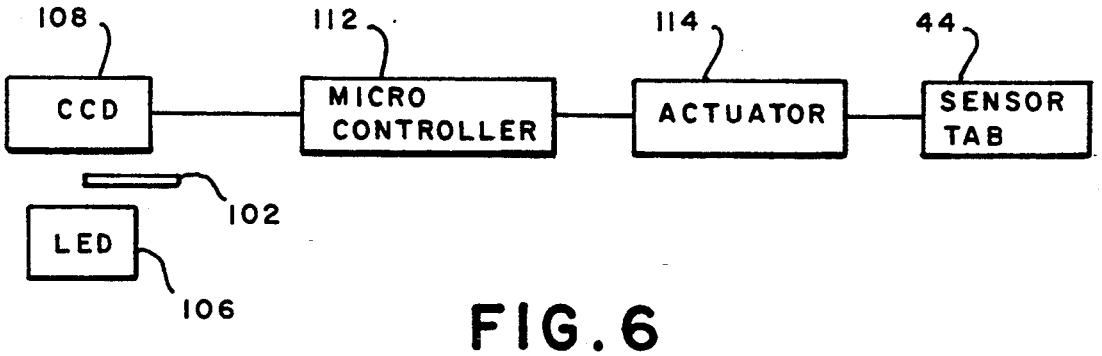
FIG. 6 is a schematic of a representative circuit diagram for the apparatus of the present invention.

FIG. 6 illustrates conceptually the control system for the scanning apparatus, and shows the LED array 106, the CCD array 108 and the masks 102 therebetween. The CCD array is connected to a micro controller 112 which has the capability of receiving the information generated by the CCD array and for comparing that information against corresponding threshold information stored in the memory of the micro controller 112, and for producing a suitable output signal if the information received from the CCD array 108 exceeds the limits of the threshold information. For example, acceptable limits or threshold values of mail thickness, mail step amplitude and location may be stored in the micro controller 112. The mail thickness information is derived from the output of the CCD array 108 and the step amplitude and location information are derived from a combination of the mail trip signal and the output of the CCD array. If we assume as threshold limits a thickness threshold equivalent to 90 percent of the cells associated with a roller 88 being obscured by a mask 104, a step amplitude threshold equivalent to a 25 percent change in thickness between adjacent rollers, or a transport direction equivalent, and a location threshold equal to $\frac{1}{4}$ inch to $\frac{3}{4}$ inch from the mail piece leading edge, these values may be stored in the micro controller 112 as binary numbers. Within the micro controller 112 the output from the CCD array 108 may be stored as binary values of time between transitions of output from high to low and low to high. Similarly the elapsed time since the mail piece trip may be stored as a binary value. As the mail piece 30 travels through the sensing area, the thickness values and the computed step and position values are sequentially compared with the threshold values. If one or more of the output values exceeds the threshold limit then the micro controller will issue a signal appropriate to the capabilities of the overall machine.

If the information received by the micro controller 112 does exceed the threshold limits, it sends a signal to a suitable actuator 114 which in turn controls an instrumentality intended to prevent a printing operation from taking place on the mail piece or causing one to take place in a different location. In the simplest embodiment, the micro controller output may be used to delay or inhibit the writing operation and illuminate a fault indicator light if appropriate. In more complex embodiments, the write head may be moved to an acceptable printing area, or critical information, such as postage values or the meter serial number may be written in acceptable areas. In the illustrated embodiment of FIG. 6, it is seen that the actuator 114 is connected to the sensor 44 and produces a signal which prevents the sensor 46 from energizing the motor 49 even through the sensor tab 44 is moved away from the sensor 46 by the lead edge of a mail piece as described above.

It is contemplated that the principles of the invention can be extended to other means of preventing a printing operation from taking place on a surface area of the mail piece which has a surface contour unacceptable for printing. For example, in a more simplified version of a mailing machine which does not have an automatic feed interrupter arrangement as in the disclosed embodiment, the actuator 114 could be connected to a bell or a light or both to provide an indication to the operator of the mailing machine to remove the mail piece from the mailing machine since it has a surface contour that is unacceptable for printing. Another possibility is for the actuator 114 to enable a time delay mechanism for motor 87 which drives the platen roller 60 and the motor (not shown) for driving the thermal ribbon take-up reel 22 so that a printing operation takes place in a different location on the mail piece, such as after a bump which is sensed by the rollers 88 in the area of the mail piece where the postage indicia is normally printed.

From the foregoing description, the operation of the scanning apparatus within the mailing machine should be apparent, but will now be briefly described. When the mail piece 30 is fed into the machine 10, it first passes between the rollers 88 and the backup roller 98, and the plurality of rollers 88 move vertically in accordance with variations in the thickness of the mail piece 30 across the area being scanned by the rollers 88, whether that is just the width of the postage indicia printing area or the entire mail piece. The movement of the rollers 88 the follower arms 92 and the masks 102 cause more or less radiation from the LED array 106 to reach the CCD array 108 as described above. As the CCD array 108 is periodically scanned while the mail piece continues to move into the mailing machine, an amplitude/-time trace is generated which constitutes an electronic contour map of the surface of the mail piece, at least in the area where the postage indicia is to be printed. The amplitude/time trace is sent to the micro controller 112 which receives and interprets the information and compares it with corresponding threshold information stored in the memory of the micro controller.

If the information received by the micro controller is within the threshold limits, when the lead edge of the mail piece 30 strikes the abutment surface 40 of the lever 36, the mail piece pivots the lever 36 clockwise to move the sensor tab 44 away from the sensor 46, thereby causing the motor 49 to be energized to rotate the cam shaft 48 and the cams 50 and 70. The cam 50 causes the lever 36 to pivot further in a clockwise direction to bring the abutment surface 40 below the level of the feed deck 28 to permit the mail piece 30 to pass thereover. The lead edge of the mail piece 30 then strikes the stop surface 58 of the lever 54 so as to register the lead edge of the mail piece with the platen roller 60, after which continued rotation of the cam shaft 48 and the cam 70 causes the lever 54 to pivot in a clockwise direction to depress the stop surface 58 below the feed deck 28. Almost immediately, with continued rotation of the cam shaft 48, the linking arm assembly 85 rocks the link plates 72 and 78 to bring the platen roller 60 into contact with the mail piece and move the eject roller 82 out of the path of the mail piece, and suitable controls in the mailing machine also energizes the motor 87 and another motor (not shown) to rotate the platen roller 60 and move the thermal ribbon 20 in synchronism so that printing can take place. When the printing operation is completed, the shaft 48 will have completed one rotation and the linking arm assembly 85 will again rock the link plates 72 and 78 in the opposite direction to disengage the platen roller 60 from the mail piece and engage the eject roller 82 therewith to eject the mail piece from the mailing machine. At the same time, the control in the mailing machine deactivates the motor 87 for the platen roller 60 and the thermal ribbon drive to stop the movement of the thermal ribbon 20 that only the amount of thermal ribbon actually required for the printing operation is utilized, thereby conserving the thermal ribbon.

If, on the other hand, the information received by the micro controller 112 is not within the threshold limits, the micro controller 112 generates a signal to the actuator 114 which in turn causes the sensor 46 not to respond when the sensor tab 46 is moved away from the sensor 44 by movement of the lever 36 in response to the lead edge of the mail piece, nothing further happens, and the operator must remove the mail piece from the mailing machine. It is to understood that the actuator 114 could be utilized to actuate other means for preventing a printing operation from taking place. As previously mentioned, in a simple form, the actuator could be utilized merely to disable further operation of the mailing machine and illuminate an indicator light. In more sophisticated mailing machines which feed mail sequentially from a hopper at relatively high speed, the actuator could allow the mailing machine to operate but disable the printing on envelopes having unacceptable printing surfaces and record the sequential numbers of the mail pieces not printed to facilitate removal of them from an accumulated stack. Still another arrangement would be to have the actuator prevent printing on an unacceptable mail piece and also operate a deflector in the mailing machine which would deflect that mail piece from the stream so that it would be readily available for hand stamping. Thus, it is intended within the scope of the invention that the actuator 114 is multifunctional and may be constructed and arranged to initiate a variety of actions all intended to prevent a printing operation from occurring on a mail piece determined to have an unacceptable printing surface.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

What I claim is:

1. In a mailing machine having means defining a feed path along which mail pieces are adapted to move, and means for printing postage indicia in a predetermined location on the mail pieces as they move along the feed path, apparatus for scanning the surface contour of the mail pieces as they move along the feed path prior to being engaged by the printing device of the postage means to determine whether the surface contour of the mail piece in the area where printing is to take place is suitable for printing and for actuating an instrumentality intended to prevent printing of the postage indicia in that area, said apparatus comprising:

A. sensing means disposed adjacent to the feed path of the mailing machine for contacting the surface of a mail piece as it moves along the feed path, B. means mounting said sensing means for movement in a direction toward and away from the surface of the mail piece in response to variations in the contour of said surface, C. electro-optical means operatively associated with said mounting means and responsive to movement of said mounting means for generating information indicative of the extent of movement of said sensing means, D. controller means for receiving and interpreting said information to determine whether said information exceeds threshold limits for said information stored in memory in said controller means, said controller means including means for producing an output signal if said information received from said electro-optical means exceeds said threshold limits for said information, and E. means responsive to said output signal from said controller means for actuating an instrumentality which prevents a printing operation from taking place on an unacceptable area of the surface the mail piece, by said printing means, whereby the operator of the mailing machine is given appropriate indication that the surface area of the mail piece where the postage indicia is to be printed has a surface contour which is unacceptable for printing.

2. Apparatus as set forth in claim 1 wherein said sensing means comprises a plurality of follower elements mounted in side by side relationship so as to independently scan the surface of the mail piece as it moves beneath said follower elements.

3. Apparatus as set forth in claim 2 wherein said mounting means comprises a plurality of follower arms corresponding to the number of follower elements, said follower arms being mounted for movement in response to movement of said follower elements from variations in the contour of the surface of said mail piece.

4. Apparatus as set forth in claim 3 wherein said mounting means further comprises means for biasing said follower arms in a direction opposite to the direction of movement of said follower arms in response to movement of said follower elements, thereby normally maintaining said follower elements in contact with the surface of the mail piece.

5. Apparatus as set forth in claim 4 wherein said mounting means further includes means operatively associated with said electro-optical means for causing said electro-optical means to generate said information in varying degree in response to movement of said follower arms so that said information is indicative of the extent of movement of said follower arms, as said follower elements follow the contour variations in the surface of the mail piece.

6. Apparatus as set forth in claim 1 wherein said electro-optical means comprises a source of radiation and a charge coupled device array responsive to radiation for generating said information.

7. Apparatus as set forth in claim 6 wherein said means operatively associated with said electro-optical means comprises means mounted on said follower arms for obscuring more or less of said radiation from said charge coupled device array in response to movement of said follower arms.

8. Apparatus as set forth in claim 7 wherein said obscuring means comprises a mask mounted on each of said follower arms, each mask having a shaped surface which obscures illumination from more or less of the individual cells of the charge coupled device associated with a particular follower arm.

9. Apparatus as set forth in claim 1 wherein said means for activating said instrumentality intended to prevent a printing operation from taking place comprises:

A. a platen roller mounted adjacent to the printing means of the mailing machine for feeding mail pieces along the feed path to and through said printing means, B. means mounting said platen roller for movement into and out of engagement with a mail piece, and C. means responsive to said output signal from said controller for moving said platen roller mounting means to disengage said platen roller from a mail piece moving past said printing means, whereby when said platen roller is disengaged from the mail piece and the printing operation does not take place thereon.

* * * * *